United States Patent [19]

Henrich

[11] 4,050,641

[45] Sept. 27, 1977

[54] APPARATUS FOR WINDING WIRE

[75] Inventor: Werner Henrich, Horbach, Germany

[73] Assignee: Firma Henrich KG, Horbach, Germany

[21] Appl. No.: 610,408

[22] Filed: Sept. 4, 1975

Related U.S. Application Data

[63] Continuation-in-part of Ser. No. 427,327, Dec. 21, 1973, abandoned.

[30] Foreign Application Priority Data

Dec. 22, 1972 Germany ..... 2262844

[51] Int. Cl.[2] ..... B65H 75/00

[52] U.S. Cl. ..... 242/47; 57/71; 242/25 R

[58] Field of Search ..... 242/47, 18 R, 25 R, 242/25 A, 54 R, 82, 83; 57/71

[56] References Cited

U.S. PATENT DOCUMENTS

| | | | |
|---|---|---|---|
| 808,084 | 12/1905 | Hardman | 57/71 |
| 1,513,403 | 10/1924 | Lebeis | 242/25 R X |
| 2,449,431 | 9/1948 | Weiss | 57/71 |
| 2,931,589 | 4/1960 | Bunch | 242/25 A |
| 3,038,674 | 6/1962 | Wahl | 242/25 R |
| 3,383,851 | 5/1968 | Hickman | 242/47 X |
| 3,449,901 | 6/1969 | Mackie | 57/71 |
| 3,677,483 | 7/1972 | Henrich | 242/25 R |
| 3,753,342 | 8/1973 | Yoshitake et al. | 242/47 X |

FOREIGN PATENT DOCUMENTS

| | | | |
|---|---|---|---|
| 469,963 | 12/1950 | Canada | 57/71 |
| 1,421,805 | 11/1965 | France | 57/71 |
| 989,681 | 4/1965 | United Kingdom | 57/71 |

*Primary Examiner*—Stanley N. Gilreath
*Attorney, Agent, or Firm*—Edmund M. Jaskiewicz

[57] ABSTRACT

In an apparatus for winding wire a spool upon which the wire is to be wound is held securely within the apparatus and a flyer having guide rollers to guide the wire upon the spool is mounted for rotary movement around the spool and for axial movement in a direction parallel to the axis of the spool. The rotary speed of the flyer can be regulated to maintain the tension of the wire constant. Limit switches are provided to define the limits of axial movement of the flyer and to reverse the direction of movement of the flyer so that the wire is wound upon the spool in uniform layers.

6 Claims, 5 Drawing Figures

APPARATUS FOR WINDING WIRE

RELATED APPLICATION

This application is a continuation-in-part of the copending application Ser. No. 427,327 filed Dec. 21, 1973 now abandoned, by the same-named applicant.

The present invention relates to an apparatus for winding wire, strands, cables, ropes and the like as delivered from manufacturing or processing machinery to be wound upon a spool, more particularly, to such an apparatus wherein the wire is wound around the spool by a flyer moving circularly around the spool and reciprocating axially of the spool.

Winding apparatus has been employed wherein wire is wound upon a rotating spool or reel. The use of such a winding apparatus is limited by the load upon the bearings supporting the spool and the drive for rotating the spool as determined by the total or gross weight of the wound wire upon the spool and the speed at which the wire is wound. It is apparent that greater weights or capacities of the wound spool are desired for the continuous processing of wire at high speeds for a number of reasons. Some of these reasons include the longer running time of the wire during subsequent processing and therefore a decrease in the number of times of changing the wire from a full spool to an empty spool. This decrease produces less interruptions during subsequent processing of the wire and as a result of a higher quality can be obtained both for the intermediate and the final product.

High winding speeds for wire are also required because the winding apparatus is generally positioned behind a unit that in most cases runs at very high speeds, such as a wire drawing machine. It is desired to utilize the capacity of such machines to their fullest extent. Wire drawing machines which are capable of operating at high speeds and for long running times have been developed in recent years. In addition, the quality of wires has been significantly improved by continuing developments in the manufacturing processes. It is therefore mandatory that during winding of the wire that the winding apparatus does not produce any deterioration in the quality of the wire.

Such a desired high standard of performance could not be obtained since known winding apparatus were not capable of operating at the high speeds and of handling the relatively large weight of wound material which would result in longer operating periods. This was true both for the winding devices where the spool is rotated and for the known winding devices wherein a flyer was used to wind the wire around the spool. In both types of winding apparatus relatively large masses had to be moved with respect to the drive and the bearings and had to be regulated with respect to the movement. The winding apparatus that utilized a flyer rotating around the spool has the same disadvantages and accordingly could be used only in those cases wherein the spool was of relatively small dimensions and thus could receive only a limited amount of wire.

In one such known winding device (U.S. Pat. No. 2,931,588) the flyer rotated at a constant speed around the spool but was in an axially fixed position. The spool was axially reciprocated in order that the wire was wound on the spool in uniform layers between the flanges thereof. The length of the stroke or distance of the reciprocating movement of the spool corresponded to the distance between the two flanges of the spool.

In order to maintain the tension of the wire constant during winding the spool was rotated in the same direction as the flyer. In this manner, the peripheral speed of the surface of the wire wound upon the spool was adjusted to the speed of the wire. As the amount of wire on the spool increased the rotational speed of the spool correspondingly increased.

When it was sought to use larger spools the weight of the wound wire was so great and such high rotational speeds of the spool had to be obtained that the angular velocity of the spool could no longer be controlled without incurring substantially greater expenditures. This increased expense was due to the necessity for providing extremely strong and heavy driving structure and bearings both for the reciprocating movement of the spool to wind the wire uniformly therearound and also for regulating the rotational speed of the spool. In addition, with respect to the winding of the wire in uniform layers it was not possible to obtain a precise and accurate reversal of the reciprocating movement of the spool at the flanges thereof because of the large mass whose direction movement had to be changed. For the same reason, it was not possible to obtain a quick and accurate regulation of the angular velocity of the spool as was required at high speeds.

Further, in this known winding apparatus the flyer rotated at a constant angular velocity while the spool itself must be continuously accelerated. This caused an increased wear of the driving and bearing elements, particularly since the spool attained its maximum rotational velocity when it carried the maximum weight of wound material thereon.

It is therefore a principal object of the present invention to provide a novel and improved apparatus for the winding of wire, cables and the like.

It is another object of the present invention to provide an apparatus for winding wire which could utilize large capacity spools without requiring a significantly heavier and stronger driving and bearing structure and wherein the wire could be wound with a great uniformity and at a high speed.

According to one aspect of the present invention an apparatus for winding wire comprised means upon which the spool to receive the wire was fixedly secured. A rotatably mounted flyer moved circularly around the spool to wind the wire thereon. The flyer is also provided with rollers for guiding the wire from a source onto the spool. The flyer is reciprocated in a direction parallel to the axis of the spool to wind the wire upon the spool. During the winding operation the spool is thus maintained in a stationary position and the flyer reciprocated in parallel to the axis of the spool and rotates around the spool.

The spool may be supported upon a wheeled transportable carriage which can be moved through an opening in the housing enclosing the apparatus and positioned within the apparatus with respect to the flyer. The spool can be constructed of a plurality of components so that the spool can be collapsed and the wire wound thereon can be removed from the spool in the form of a coil.

Other objects and advantages of the present invention will be apparent upon reference to the accompanying description when taken in conjunction with the following drawings, which are exemplary, wherein.

Proceeding next to the drawings where like reference symbols indicate the same parts throughout the various views a specific embodiment and modification of the present invention will be described in detail.

Figure 1:
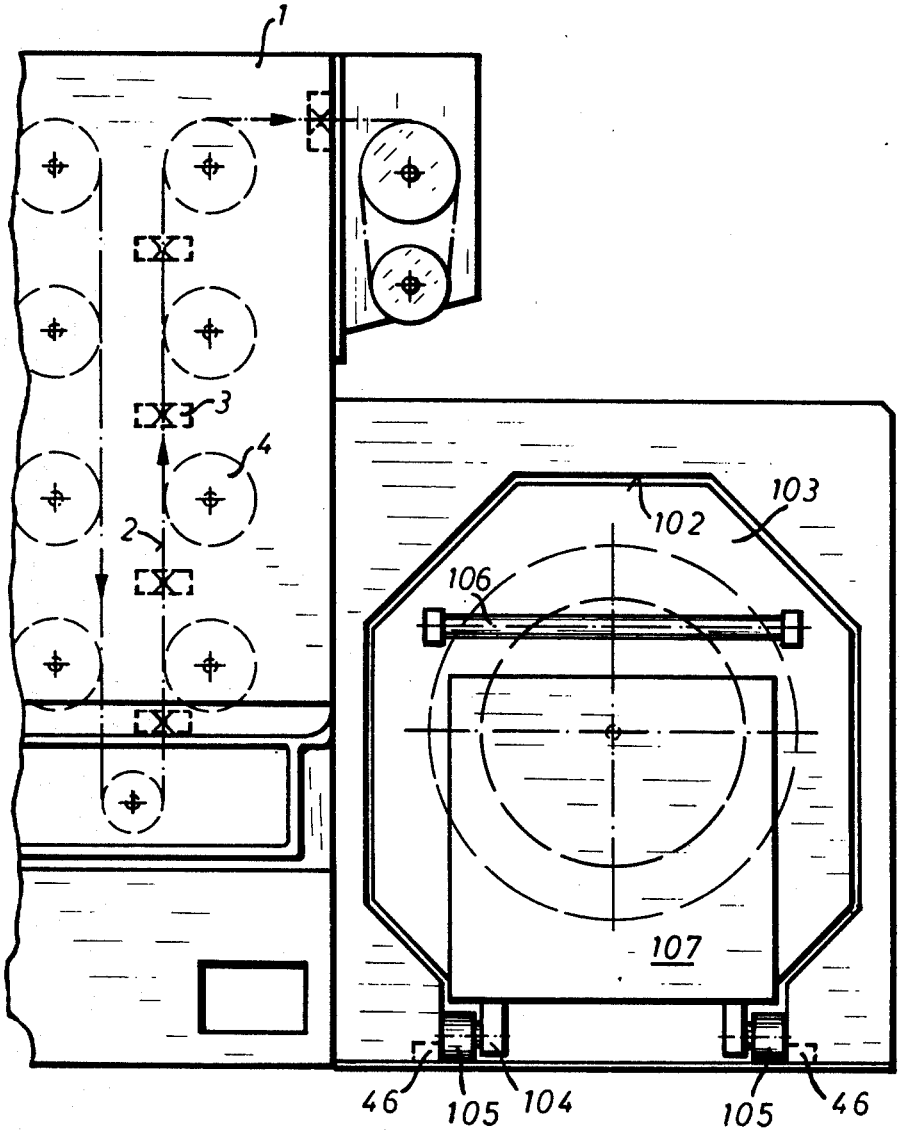
FIG. 1 is an end elevational view of a wire drawing machine and of a winding apparatus according to the present invention in conjunction therewith.
Figure 2:
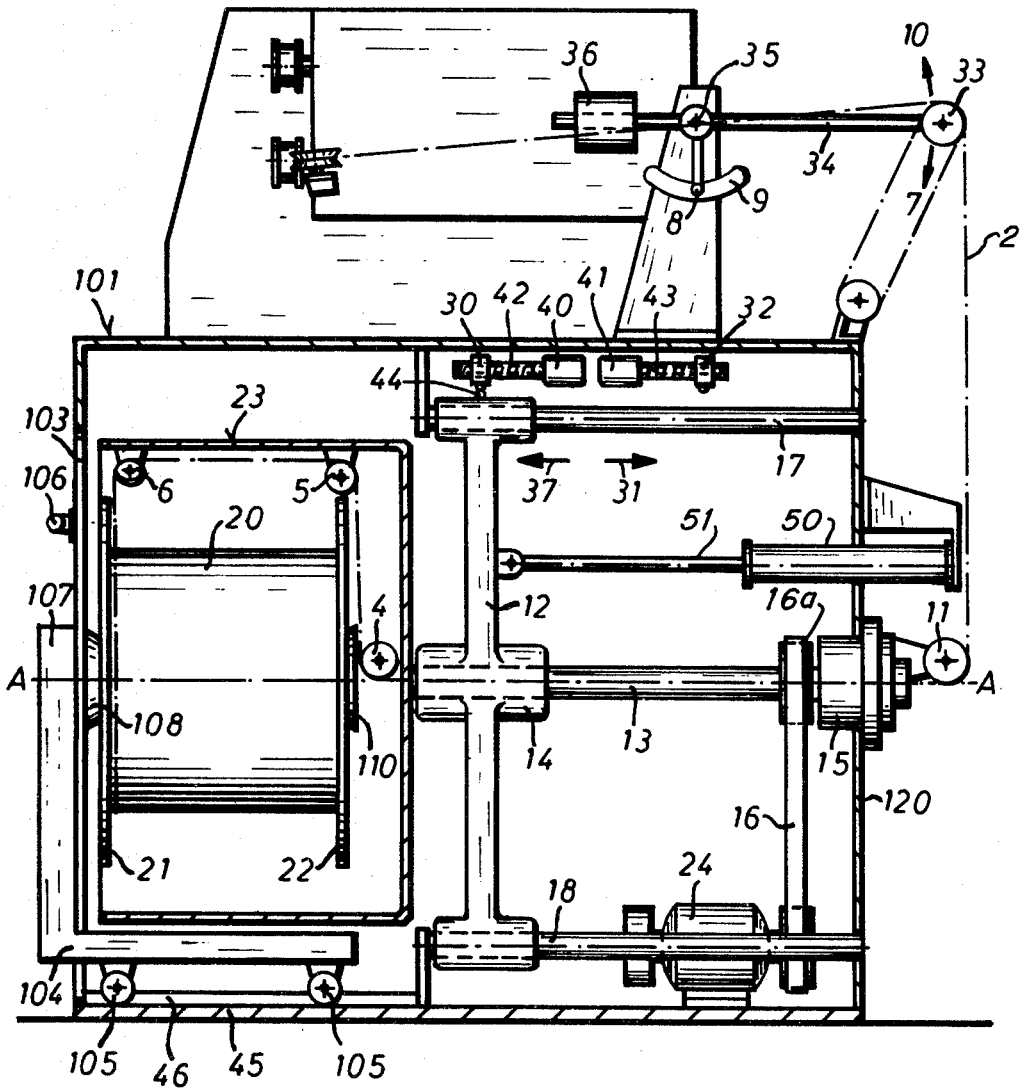
FIG. 2 is a side elevational view of the structure of FIG. 1.

With particular reference to FIGS. 1 and 2, there is illustrated a wire drawing machine 1, within which a wire 2, is pulled through drawing dies 3, by means of driven drawing rolls 4. After drawing, the wire may be subjected to further treatment such as annealing in an apparatus which is not illustrated. The wire leaves the drawing machine 1 and is guided over a compensating roller 33 mounted on the end of a lever 34 which is pivotally mounted at 35. A predetermined tension may be placed on the wire by the compensating roller by the selection of a suitable weight 36.

U.S. Pat. No. 3,677,483, Column 2, lines 21–53 is incorporated herein by reference to describe the function of the wire tensioning device.

Upon an increase in the tension of the wire because of the increase in the diameter of the wire wound on the spool 20 which in turn increases the speed of the wire, the compensating roller 33 will move downwardly in the direction indicated by the arrow 7. This movement of the compensating roller may be employed for adjusting the winding velocity of the wire with respect to the wound diameter on the spool by means of a contact 8 extending from lever 34 and movable over a rheostat 9. The rheostat can be connected to electric speed controls in a manner known in the art. Upon a decrease in the tension of the wire which would occur when the wire runs into a depression or recess on the surface of the wire wound upon the spool, the compensating roller 33 will move upwardly in the direction of the arrow 10 and the reverse operation will occur to control the speed of the wire.

The wire runs from compensating roller 33 over a roller 11 mounted on the housing 120 which encloses the wire winding apparatus. The wire then passes through a hollow shaft 13 over a roller 4 and guide rollers 5 and 6 to the spool 20. The guide rollers 4, 5 and 6 are mounted upon a frame 23 and, together with this frame, form the flyer.

The pulley 11 which is fixed to the housing 120 is structurally positioned further to the right so that when the shaft 13 is moved to the right the guide roller 11 will still be positioned to the right of the end of the shaft 13. As illustrated, the dimensions of the brackets supporting the guide roller 11 are not to scale but are for the purposes of illustrating the structural aspects of the invention.

The flyer is pivoted in bearings 14 and 15 mounted within the winding apparatus and rotates around the spool 20 in order to wind the wire upon the spool. The flyer is also reciprocated continuously along the axis A—A which is parallel to the axis of the spool. The rotary movement of the flyer is obtained through a variable speed gearing 24 which is driveably connected by a belt 16 to pulley 16a mounted on the shaft 13. The variable speed gearing is either driven separately or from a unit working in conjunction with the winding apparatus such as a wire drawing machine. Another variable speed driving unit may also be employed in place of the variable speed gearing.

The spool 20 is provided with flanges 21 and 22 between which the wire is wound. The reciprocating movement of the flyer for the purpose of uniformly winding the wire in layers between the flanges 21 and 22 is achieved by shifting a guide structure 12 upon shaft 13 and along two guide rods 17 and 18 by means of a hydraulic or pneumatic cylinder 50 having a piston rod 51 connected to the guide structure. A mechanical, electric or similar such drive may also be used to reciprocate the flyer.

In FIG. 2 the flyer is illustrated in the extreme left-hand position with respect to the spool 20 which is positioned in the winding apparatus to receive the wire. In this position the roller 6 guides the wire upon the spool 20 adjacent flange 21. The guide structure 12 of the flyer is provided with a cam 44 which contacts a limit switch 30 to reverse the movement of the guide structure 12 through a control circuit known in the art and not illustrated. Upon this reversal, the guide structure 12 is moved in the direction of the arrow 31. As the guide structure 12 moves to its extreme position at the right the collar 6 will wind wire adjacent the flange 22. At this point, the cam 44 will contact a second limit switch 32 which again reverses the direction of movement of the guide structure 12 so that this structure then moves to the left in the direction of arrow 37.

The shaft 13 has a polygonal or non-circular cross-section and is slideable through the pulley 16a and bearing 15 which are retained in their respective positions as shown in FIG. 2. The displacement of the guide structure 12 may also be brought about by slidably mounting the variable speed gearing 24 upon base 45 and for extending the shaft or guide rod 18 so that this rod is also slidable through the housing end wall 120. Thus, the variable speed gearing 24 and the drive belt 16 are displaceable together with the movable guide structure 12. In this modification, the bearing 15 is mounted further to the right and the shaft 13 is extended in length so as to be slidable within the bearing 15.

With reference to reciprocating the flyer frame 23 and shaft 13, the shaft 13 is journalled in the bearing block 14 of the frame 12 and this journal provides the connection between shaft 13 and frame 23. Actuation of the motor 50 to move the frame 12 to the right in the direction of the little arrow 31 will also bring about a movement of the shaft 13 and frame 23 to the right.

In order to prevent an accumulation or absence of wire in the vicinity of spool flanges 21 and 22 the points of reversal of guide structure 12 or of flyer 23, 4, 5, 6 as determined by the end limit switches 30 and 32 must be precisely and exactly determined as disclosed in U.S. Pat. No. 3,677,483, Column 2, line 73-Column 4, line 46 incorporated herein by reference.

Thus, upon the occurrence of a depression or accumulation of wire in the vicinity of one of the spool flanges and because of a variation in the wire tension resulting therefrom, the compensating roller 33 will vary the voltage supplied to an electric motor 40 or 41 operatively connected to the limit switches 30 and 32 respectively to change the position of the respective limit switches by spindle 42 or 43. The operation of the electric motor will rotate the spindle which will cause a limit switch mounted thereon to move and the movement of the limit switch will define the new end or reversal point of the flyer.

As may be seen in FIGS. 1 and 2 the housing 120 has an opening 102 formed in the wall thereof to permit the introduction or removal of a spool with respect to the winding apparatus 101. The spool 20 is carried upon a transportable carriage 104 mounted on rollers 105. The carriage 104 is also provided with a shield plate 103 which has a shape closely conforming to the shape of opening 102 as can be seen in FIG. 1. A handle 106 is mounted on the shield 103 to enable the carriage to be pulled from or pushed into the opening 102. A reinforcement plate 107 is also mounted upon the shield 103 and is provided with a take-up pin 108 upon which the spool 20 is mounted. The spool 20 is attached to the pin 108 by means of a nut 110.

Figure 4:
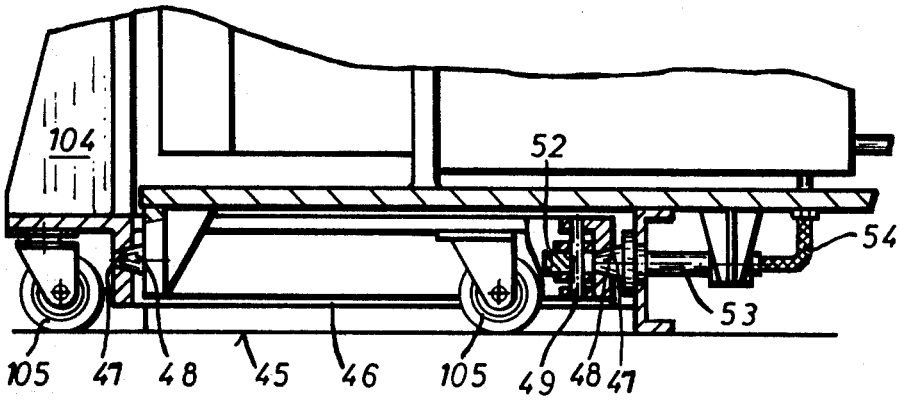
FIG. 4 is a vertical sectional view of the lower portion of the winding apparatus and carriage.
Figure 5:
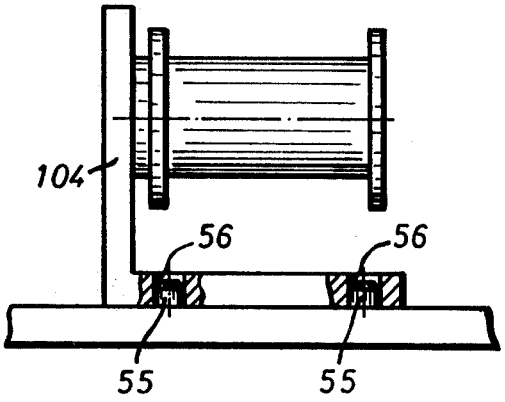
FIG. 5 is an elevational view partially in section and in reduced scale of the winding apparatus and carriage showing a further structure for centering and locking the carriage.

The winding apparatus 101 is provided with a base plate 45 upon which guides 46 are mounted to align and position the carriage 104 with respect to the flyer. The lower portion of the frame of the carriage 104 is provided with three depending triangularly positioned brackets in which are formed the conical openings 47 which are seated on to conical pins 48 carried by brackets mounted on the frame of the apparatus as may be seen in FIG. 4. The forward or right end of the carriage as viewed in FIG. 4 has a single centrally located bracket and the rear or left end has two laterally positioned brackets. The brackets on the apparatus carrying the pins 48 are correspondingly spaced so that two lateral brackets permit the forward bracket on the carriage carrying the opening 47 to pass therethrough into its end or aligned position of FIG. 4. Thus, in its end or aligned position the conical openings 47 of carriage 104 are seated onto conical pins 48 and the pins 48 align the carriage in a precise manner so that the spool is accurately positioned with respect to the flyer frame 23. The carriage has a vertical pin 49 adjacent its single bracket which is locked by a latch 52 movable in a horizontal plane and powered by a pneumatically or hydraulically activated motor 53 supplied through line 54. The motor 53 is positioned to the right of the single right end bracket of the apparatus. As a modification, the carriage may be centered and locked in position by a plurality of vertically movable centering pins 55 which are raised to be inserted in corresponding holes 56 in the bottom of the carriage as shown in FIG. 5.

The spool can be constructed of separable components which can be detached from each other to enable the wire to be removed from the spool in the form of a coil. The flange 22 of spool 20 can be removed after nut 110 has been removed and detached from the pin 108. Such a detachable structure is not limited to spools of large dimensions upon which a large amount of wire can be wound but can also be employed in much smaller spools.

Figure 3:
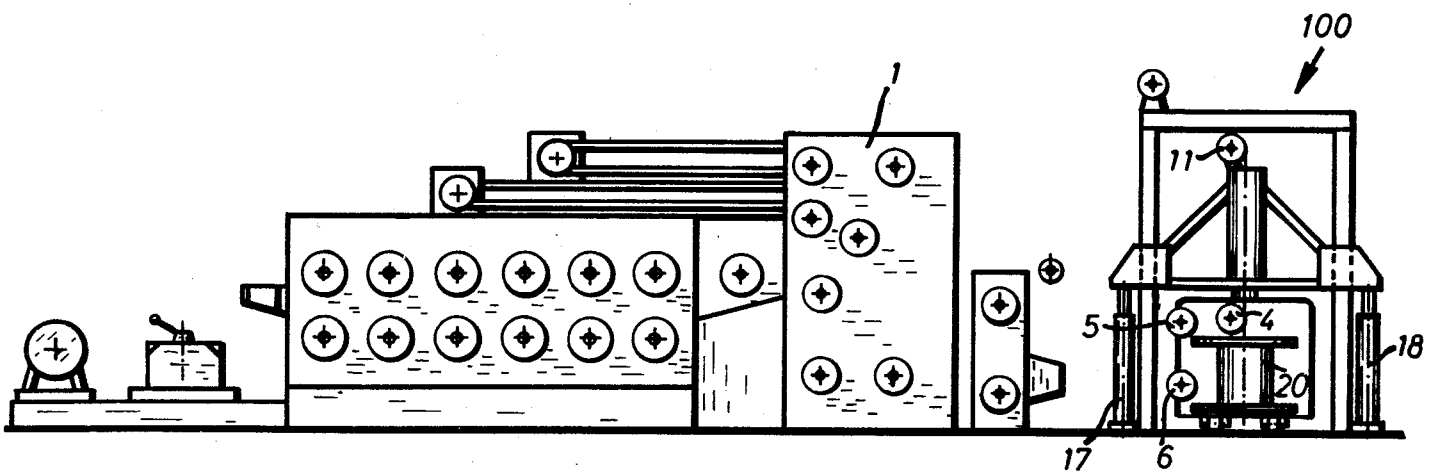
FIG. 3 is an elevational view of a modification of the winding apparatus.

In FIG. 3 there is shown a modification of the present invention wherein the wire drawing machine 1 is in conjunction with a winding apparatus 101 positioned subsequently to the drawing machine. In this winding apparatus the axis of the spool 20 is oriented vertically so that the flyer rotates about the corresponding vertical axis.

The structure for sensing the tension of the wire immediately prior to being wound upon the spool may comprise a compensating roller such as disclosed in the German printed specification No. 1946220 or as described above. This compensating roller can thus control automatically the position of the reversal points of the reciprocating movement of the flyer such as by the displacement of the limit switches which a flyer cam abuts or in some other manner.

It is apparent that with this invention the flyer can rotate at a relatively high speed. The magnitude of the angular velocity of the flyer is limited only by centrifugal forces which might lead to high bearing loads on the guide rolls of the flyer. This would mean that the rolls can no longer be driven merely by the movement of the wire over the rolls. To overcome this disadvantage at least one guide roll is constructed with fan blades, or carries a propeller, so that air striking the blades or propeller exerts an additional torque upon the guide roll. It is preferable that the guide roll which is subjected to the greatest load should be provided with such a fan blade construction in the event that only one roll is to be so constructed. A suitable structure as known in the art may also be provided for adjusting the fan blades in order to regulate the amount of torque which is additionally exerted.

The mounting of a spool on a moveable carriage thus facilitates movement of the spool, particularly when a heavy fully-wound spool is to be replaced with an empty spool. The use of this transportable carriage enables this replacement to occur with a minimum of time so as not to interrupt the operation of the wire drawing machine. If there is any interruption of the operation this interruption is only for a very short period of time. The extreme weight of the fully wound spools thus does not unduly encumber the manipulation of these spools in the replacement of a wound spool with an empty spool. Ths axis of the spool upon the carriage may be oriented either vertically or horizontally depending upon the structure of the winding apparatus. For relatively thin wire, it is preferable that the axis is horizontal since in the case of such thin wire the individual coils thereof have the tendency of sliding downwardly on a spool whose axis is positioned vertically.

The movement of the carriage into and out of the winding apparatus can be accomplished by suitable driving devices such as magnetically, by rails and in the case of relatively small spools manually. The actual mounting and removal of the spool from the carriage is carried out outside of the winding apparatus.

It is therefore apparent that the winding apparatus of the present invention is advantageous in that the flyer has a relatively low mass which remains constant during the entire winding operation. The relatively low and constant mass thus greatly facilitates the rotation and axial reciprocation of the flyer during the winding operation. Further, the elimination of the reciprocating wire spooling device provided with a rotating spool in the known winding apparatus is now possible because the function of the spooler or level winder is now taken over by the flyer. Further, reciprocating of the spool itself is eliminated. Since a spool such as employed in the present invention may weigh five tons or more there is thus eliminated a considerable expenditure of force and energy for the purpose of reciprocating such a heavy spool. However, it is pointed out, that in special applications it may be desirable to reciprocate the spool in connection with adjusting the angular velocity of the flyer of the present invention.

The present invention also provides for positioning the wire precisely adjacent to the flanges of the spool. This cannot be done with a reciprocating spool as in the known winding devices because of the great weight and mass of the spool which must be controlled. Further, the weight of the spool changes constantly during the winding operation and this brings about effects which cannot be controlled. Since the reciprocation of the flyer occurs precisely at the flanges of the spool according to the present invention accumulation of wound wire at the flanges is thus avoided.

The present invention enables the winding apparatus now to be employed in conjunction with other machinery such as a wire drawing machine and to achieve the high operating speeds and long operating periods which have long been sought. The use of the present winding apparatus is also advantageous for a wire drawing machine since there is a considerable reduction in the number of starts and stops of the driving and transmission elements and consequently a decrease in the wear of these parts. There is also reduced wear of the drawing dies from slippage during the starting and breaking phases. The danger of wire breakage is also significantly decreased. The long operating periods reduce the number of spool replacement operations that must occur or, in the case of double spoolers, the wire need not so frequently be switched from one spool to another. This significantly reduces the danger of breaking of the wire, decreases the slippage and shock loads upon the wire no longer occur.

It will be understood that this invention is susceptible to modification in order to adapt it to different usages and conditions, and accordingly, it is desired to comprehend such modifications within this invention as may fall within the scope of the appended claims.

What is claimed is:

1. An apparatus for winding a strand, such as wire, cable, rope and the like, upon a spool comprising means for fixedly securing thereon a spool upon which the strand is to be wound, a rotatably mounted flyer movable around the spool to wind the strand thereon, and means for reciprocating said flyer between two end points in a direction parallel to the axis of the spool to wind the strand upon the spool and to control the axial movement of said flyer to wind the strand on the spool in uniform layers, said flyer comprising a cylindrical frame having a closed end and enclosing the spool at one of said end points, a hollow rotatable shaft attached to said frame closed end and the strand entering the closed end of said frame at the rotary axis to the spool through said hollow shaft, a plurality of rollers within the frame on the inner face thereof for guiding the strand entering the flyer such that outward movement of the strand within the rotating flyer resulting from centrifugal force is limited by the inner face of said frame whereby breaking of the strand is prevented and the strand is enclosed within said hollow shaft and frame during winding on the spool.

2. An apparatus as claimed in claim 1 and means for regulating speed of rotation of the flyer to maintain the tension of the strand constant during the winding thereof.

3. An apparatus as claimed in claim 1 and means for sensing the tension of the strand during winding, and means responsive to said tension-sensing means for controlling the positions of the end points to reverse the axial movement of said flyer in the vicinity of the flanges of the spool upon which the strand is being wound.

4. An apparatus as claimed in claim 1 and limit switch means positioned to correspond to the reversal points of the axial movement of the flyer, and cam means on said flyer for contacting said limit switch means at each end point of the reciprocating movement of the flyer.

5. An apparatus as claimed in claim 1 wherein said spool securing means comprises a wheeled transportable carriage including a reinforcement plate having a take-up spin extending thereon upon which said spool is mounted.

6. An apparatus as claimed in claim 5 and comprising a housing enclosing the apparatus, there being an opening in a side of said housing through which said carriage is movable, a shield on said reinforcement plate, said opening conforming substantially to the outline of said shield, and means within said housing for aligning and positioning said carriage with respect to said flyer.

* * * * *